United States Patent [19]

Watanabe et al.

[11] Patent Number: 4,603,806

[45] Date of Patent: Aug. 5, 1986

[54] METHOD OF MANUFACTURING METAL PIPE WITH LONGITUDINALLY DIFFERENTIATED WALL THICKNESS

[75] Inventors: Kazuo Watanabe; Hiromi Seki; Kenji Yamada, all of Kitakyushu; Yoshito Tsuyama, Tokyo, all of Japan

[73] Assignee: Nippon Steel Corporation, Tokyo, Japan

[21] Appl. No.: 638,615

[22] Filed: Aug. 7, 1984

[30] Foreign Application Priority Data

| | | | |
|---|---|---|---|
| Aug. 11, 1983 | [JP] | Japan | 58-145637 |
| Aug. 11, 1983 | [JP] | Japan | 58-145638 |
| Aug. 11, 1983 | [JP] | Japan | 58-145639 |
| Jan. 18, 1984 | [JP] | Japan | 59-5516 |
| Jan. 18, 1984 | [JP] | Japan | 59-5517 |

[51] Int. Cl.[4] ..... B23K 28/02

[52] U.S. Cl. ..... 228/152; 228/144; 138/171; 428/600

[58] Field of Search ..... 228/144, 152, 170, 172; 138/170, 171, 128; 72/413, 414, 416, 368, 51; 428/573, 600

[56] References Cited

U.S. PATENT DOCUMENTS

| | | | |
|---|---|---|---|
| 379,026 | 3/1888 | Parsons | 228/144 X |
| 653,903 | 7/1900 | Bray | 228/152 |
| 1,310,130 | 7/1919 | Murray | 138/171 |
| 1,623,064 | 4/1927 | Napier | 228/170 X |
| 1,978,685 | 10/1934 | Mogford et al. | 228/144 |
| 2,104,688 | 1/1938 | Adell | 228/152 |
| 2,286,971 | 6/1942 | Murray et al. | 428/600 X |
| 4,148,426 | 4/1979 | Midzutani et al. | 228/146 |

FOREIGN PATENT DOCUMENTS

| | | |
|---|---|---|
| 2364074 | 4/1978 | France . |
| 221616 | 12/1983 | Japan . |
| 761071 | 9/1980 | U.S.S.R. . |

*Primary Examiner*—Nicholas P. Godici
*Assistant Examiner*—Carmine Cuda
*Attorney, Agent, or Firm*—Wenderoth, Lind & Ponack

[57] ABSTRACT

First, a rectangular metal plate having thinner and thicker portions corresponding to a lighter-wall portion and heavier-wall portion of a pipe to be manufactured is prepared. Before bending the plate until both edges thereof meet to form a tubular piece, the plate width is adjusted by cutting off part of the thinner portion so that the desired peripheral lengths are attained in both lighter- and heavier-wall portions of the pipe. The width-adjusted plate is then bent until both edges are butted together to form a tubular piece. By butt-welding the adjoining edges, a metal pipe with longitudinally differentiated wall thickness is obtained.

8 Claims, 18 Drawing Figures

METHOD OF MANUFACTURING METAL PIPE WITH LONGITUDINALLY DIFFERENTIATED WALL THICKNESS

BACKGROUND OF THE INVENTION

1. Field of the Invention

This invention relates to a method of manufacturing metal pipe with longitudinally differentiated wall thickness.

2. Description of the Prior Art

Recently, exploitation of offshore oil fields (including gas fields) has been carried out at increasingly great depths. Fixed drilling platforms fastened to the seabed used to be the main equipment employed in oil and gas prospecting and exploitation. The need to work in deeper water has brought about the evolution of flexible-structure drilling platforms. One example is a tension-leg platform.

The tension-leg platform is a floating drilling platform that is secured to its anchoring members on the sea floor by means of the so-called tension legs comprising a number of steel tubular members screwed together. Usually, each tubular member is approximately 12 m long, having an external thread (a pin section) and an internal thread (a box section) cut at each end thereof. The pin and box sections are also generically called connector sections. To ensure adequate strength, the threaded connector sections at both ends are heavier in wall thickness than elsewhere. While in service, drilling platforms are subjected to everchanging forces exerted by winds, waves, currents and tides. So, the tubular members are required to have high enough fatigue strength to endure the stresses induced by such forces under seawater.

In manufacturing the tubular tension legs, the conventional practice has been to form the connector sections or the pin and box sections by forging. With the pipe having longitudinally differentiated wall thickness or outside diameter, however, such forging is not only time-consuming but also uneconomical because of the need to finish with machining.

SUMMARY OF THE INVENTION

An object of this invention is to provide an inexpensive method of manufacturing metal pipe with longitudinally differentiated wall thickness by bending and welding, instead of forging.

Another object of this invention is to provide a method of manufacturing metal pipe with longitudinally differentiated wall thickness with high dimensional accuracy.

To implement the method of this invention, a rectangular metal plate has to be prepared, which has opposite edges which abut a heavier-wall portion and a lighter-wall portion of the plate the portion corresponding to the heavier wall portion of the finished pipe having greater thickness than a portion corresponding to the lighter wall portion. Such a metal pipe which is thicker at both ends than in the middle can be prepared by passing a slab of uniform thickness through a reversing plate mill and performing a reversed rolling midway in the final pass. The thicker portion at both ends is then levelled by either pressing or machining so that one surface of the plate forms a continuous, flat plane throughout.

Before being bent thoroughly until both edges are in contact to form a tubular shape, the middle portion of the material plate corresponding to the lighter wall portion is partly cut away to make the width thereof smaller than that of both ends corresponding to the heavier wall portion, thereby ensuring that the finished pipe will attain a periphery of the desired length. This width adjustment is done before the forming operation is started, or after both edges have been pre-formed, or after the material plate has been formed mostly but not completely into a circle.

The width-adjusted material plate is then bent until both edges meet to form a tubular shape either by punch-and-die pressing or roll-bending.

On welding the butted edges, a metal pipe with longitudinally differentiated wall thickness is completed.

DESCRIPTION OF THE PREFERRED EMBODIMENTS

Figure 1:
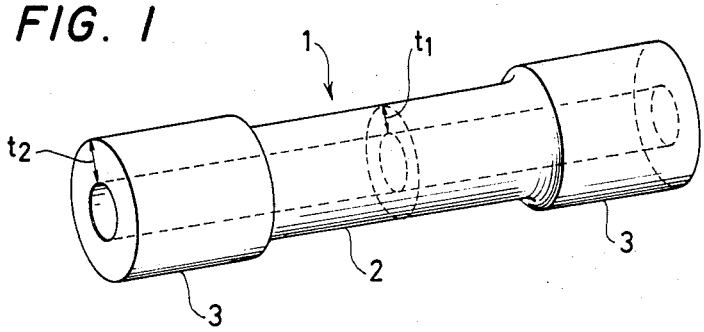
FIG. 1 is a perspective view of a metal pipe with longitudinally differentiated wall thickness manufactured by the method of this invention.

A pipe 1 to be manufactured consists of a lighter-wall portion 2 having a thickness $t_1$ and an externally protruding heavier-wall portion 3 having a thickness $t_2$, as shown in FIG. 1.

Figure 2:
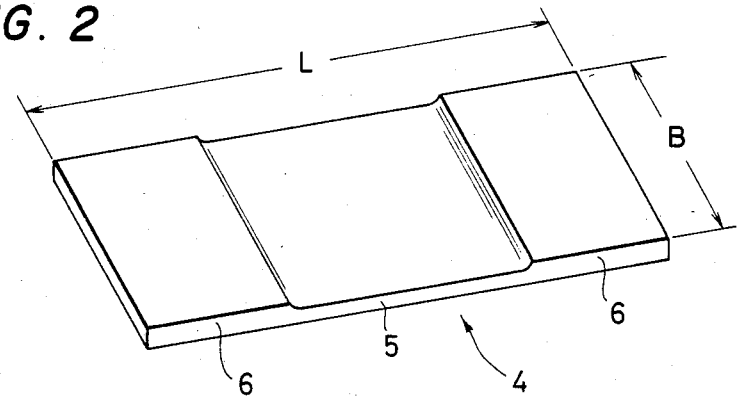
FIG. 2 is a perspective view of a material plate before being bent.

In making a metal pipe 1 with longitudinally differentiated wall thickness (hereinafter called the differential-thickness pipe), a material plate 4 having a thinner portion 5 and a thicker portion 6, as shown in FIG. 2, is prepared first. The thicknesses of the thinner and thicker portions 5 and 6 of the material plate 4 are respectively equal to those of the lighter- and heavier-wall portions 2 and 3 of the pipe 1, with the length L of the plate being equal to the length of the differential-thickness pipe 1.

The plate width B can be adjusted by either method I or method II as described below, both of which involve an end-facing process.

Method I: The edges of the thinner and thicker portions 5 and 6 are cut and machined to different widths so that the desired outside diameters will be obtained.

Method II: The material plate is cut to a width B that is sufficiently large enough to obtain the desired outside diameter.

The choice between the two methods depends upon the wall thickness and desired accuracy of the pipe to be made. Generally, method I is applicable to thinner plates, whereas method II is suited for heavier plates and pipes calling for stricter diametrical accuracy.

Such a metal plate which is thicker at both ends than in the middle can be prepared by passing a slab of uniform thickness through a reversing plate mill and performing a reversed rolling midway in the final pass. The thicker portion at both ends is then levelled by either pressing or machining so that one surface of the plate forms a continuous, flat plane throughout.

A detailed description of the two plate width adjusting methods is given below.

METHOD I

Figure 3:
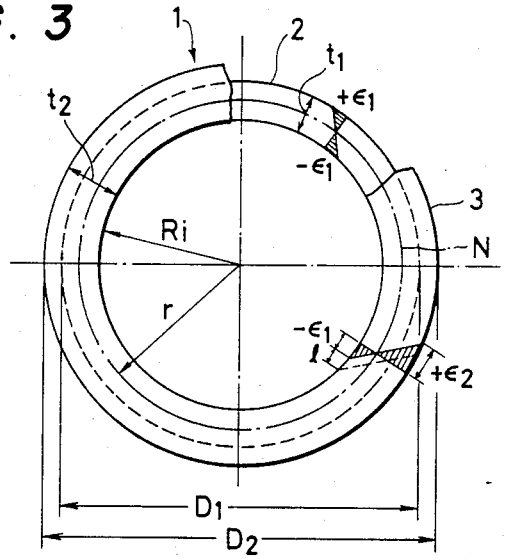
FIG. 3 is a cross-sectional view of a metal pipe with longitudinally differentiated wall thickness.

Let us assume that a circle defined by the neutral plane N in the thinner portion 2 of a differential-thickness pipe 1 shown in FIG. 3 has a radius r, then the required plate width B is determined as $2\pi r$ ($B=2\pi r$) based on the peripheral length of the pipe. Actually, however, the relationship between the plate width B (or the peripheral length of the circle defined by the neutral plane) and the peripheral length of the pipe varies with the strength of plate, curvature of bend and other factors. Therefore, it is not easy to provide a plate 4 having a thicker portion 6 and a thinner portion 5 with such a width B as can ensure attainment of the desired peripheral lengths in both portions. If the differential-thickness pipe 1 having an inside radius Ri as shown in FIG. 3 is obtained from a plate of uniform width B, the circumferential distortion across the plate thicknesses in the heavier and lighter portions 3 and 2 will be compressive and tensile on the inside and outside of the neutral plane N, respectively, as illustrated. The distortions at the internal and external surfaces of the heavier-wall portion 3 will then be $-\epsilon_1$ and $+\epsilon_2$. Accordingly, a uniform circumferential elongation l must be provided across the thickness of the heavier-wall portion 3 so that the neutral plane of the heavier-wall portion agrees with that of the lighter-wall portion. Because of the longitudinally differentiated wall thicknesses and relatively different cross-sectional areas of the two portions, however, it is difficult to cause the piece being bent to simultaneously undergo such a uniform elongation. Therefore, the uniform elongation in the heavier-wall portion 3 is usually smaller than l.

Figure 4:
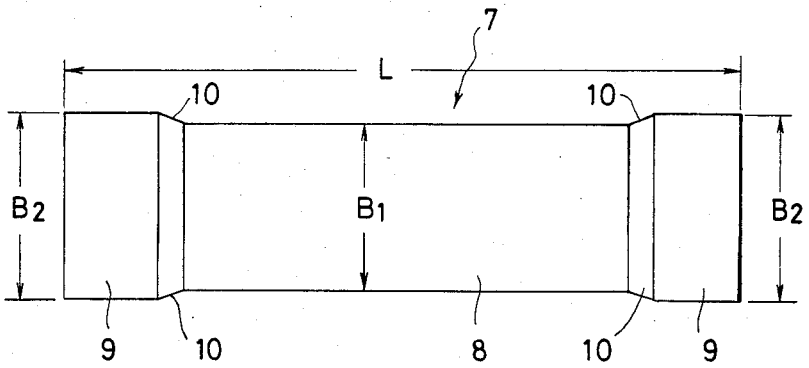
FIG. 4 is a plan view of a material plate with longitudinally differentiated thickness, with a portion of both edges thereof cut away.

As a consequence, the actual outside diameter of the heavier-wall portion 3 of the differential-thickness pipe 1 is smaller than the aimed-for value, and the inside diameter of the heavier-wall portion 3 does not agree with that of the lighter-wall portion 2. The net result is that the differential-thickness pipe 1 of the desired size cannot be made from the plate 4 having a uniform width B throughout the length thereof. Accordingly, it becomes necessary to provide different widths $B_1$ and $B_2$ as in the thinner and thicker portions 8 and 9 shown in FIG. 4 which are defined as follows:

$$B_1=\pi(D_1-t_1)+b_1$$

$$B_2=\pi(D_2-t_2)+b_2$$

where $D_1$ and $D_2$ are the desired outside diameters of the lighter- and heavier-wall portions 2 and 3, $t_1$ and $t_2$ are the wall thicknesses thereof, and $b_1$ and $b_2$ are the values used to correct changes in the elongation at the external surface of the pipe that might arise when the neutral plane N, in which no forming-induced circumferential elongation occurs, is not positioned just at the center ($\frac{1}{2}$) of the plate width. The values of $b_1$ and $b_2$ vary with the plate strength, forming method and other factors, but usually fall within the following ranges: $b_1=(-0.2 \text{ to } -0.9)t_1$ and $b_2=(-0.2 \text{ to } -0.9)t_2$.

Figure 5:
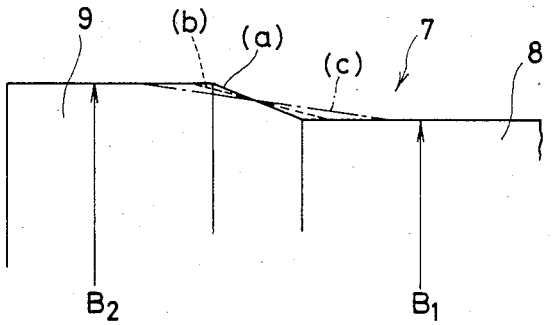
FIG. 5 shows the line along which said edge cutting is done in the thickness-changing region between the heavier- and lighter-wall portions of the material plate or pipe.

The transition portion 10 where plate thickness changes may be defined by one of three cut-off lines shown in FIG. 5. The inclined portion of the cut-off line (a) connects the lighter- and heavier-wall portions in such a manner as to conform to a change in pipe wall thickness. The inclined portion of the cut-off line (b) essentially agrees with that of the cut-off line (a) except that each end thereof consists of an arc between the horizontal portions of the plate and inclined portions of the cut-off line (a) so that the lighter- and heavier-wall portions are connected more smoothly. The inclined portion of the cut-off line (c) is more gently sloped than that of cut-off line (a) and consists of a middle straight portion and an arc contacting each end of the straight portion and the horizontal portion of the plate. The unnecessary portion of the plate is cut off along the chosen line.

Cut-off line (a) extends from the thicker portion to the thinner portion only in the area of the transition portion 10. Cut-off lines (b) and (c) are formed by removing portions of the plate between the thicker portion and the thinner portion such that the width of the plate beyond the transition portion 10 towards the thinner portion is greater than the width of the thinner portion and the width of the plate beyond the transition portion towards the thicker portion is less than the width of said thicker portion with the width of the transition portion being intermediate the width of the plate on either side of the transition portion.

Preferably, the plate width in the transition portion 10 should be changed gradually along the cut-off line (c). When a plate having differentiated thicknesses is cut along the line (a) or (b), the resulting transition portion will affect the adjoining areas. More specifically, the outside diameter in the adjoining areas too will vary. In determining the plate width taper, therefore, allowance should be made for such an effect. When both edges are brought together for tack welding, an opening left therebetween varies so widely from one point to another that great force will have to be exerted to butt together both edges evenly. The pipe itself might even deform before both edges thereof have been properly butted together. It is therefore desirable to change the plate width gradually as along the cut-off line (c).

The contour of the plate edges, however, is not limited to any specific one shape, but, rather, can be chosen in accordance with the accuracy with which pipe diameter is determined, plate edges being set end to end and butt-welded together.

Both edges of the width-adjusted plate are machined to form, for instance, a double-V groove when they are butted together by bending. Edge preparation is accomplished by fusing and machining.

Figure 7:
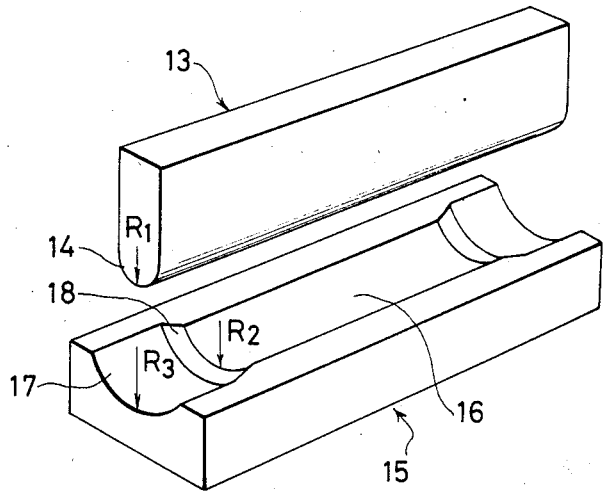
FIG. 7 is a perspective view showing an example of a punch and die of a press bender used in the bending operation.

The material plate 7 thus prepared is bent into tubular form by a press bender. FIG. 7 shows a punch 13 and a die 15 of a press bender.

The pressing end 14 of the punch 13 is smoothly curved, with the radius of curvature $R_1$ thereof being made equal to or smaller than the inside radius of the differential-thickness pipe 1 to be manufactured. The radius of curvature $R_2$ of a portion 16 of the die 15 that corresponds to the lighter-wall portion 2 of the pipe is equal to or slightly smaller than the outside radius of the lighter-wall portion 2, whereas the radius of curvature $R_3$ of a portion 17 corresponding to the heavier-wall portion 3 is equal to or slightly smaller than the outside radius of the heavier-wall portion 3. Between the portions 16 and 17 of the die 15 corresponding to the lighter- and heavier-wall portions of the pipe is provided a transition portion 18 where the die profile changes gradually in order to avoid an abrupt change in the resulting pipe wall thickness.

METHOD II

Figure 8:
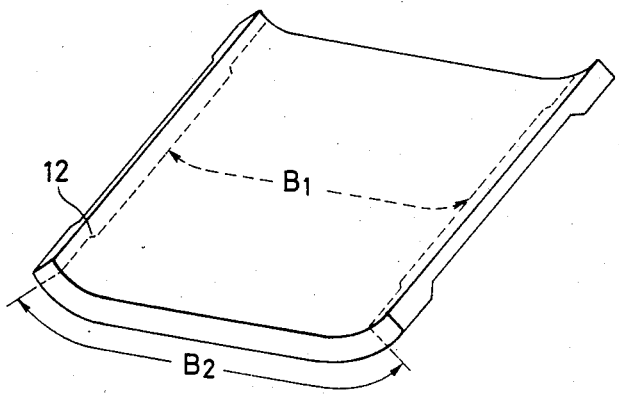
FIG. 8 is a perspective view of a material plate immediately after the edge-forming operation.
Figure 9:
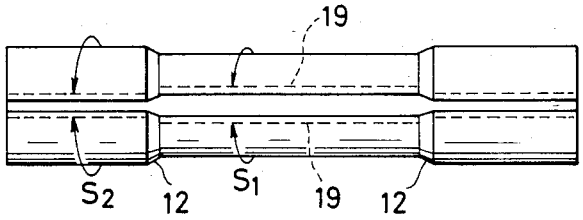
FIG. 9 is another top view of a tubular product immediately after the bending operation.

According to this method, the original plate width B is provided with an ample margin that is cut off later after the forming operation has proceeded to some extent. Here, the plate width $B=90\ (D_2-t_2)+b$. The margin $b=(0.5 \text{ to } 2)t_2$. Using the press bender shown in FIG. 7, the material plate 4 thus prepared is first bent only at the edges thereof to form an arched piece as shown in FIG. 8. The piece may also be bent further into a tubular form as shown in FIG. 9. Then, the width B of the bent piece is cut down to widths $B_1$ and $B_2$ so that the peripheral lengths $S_1=\pi D_1$ and $S_2=\pi D_2$ of the lighter- and heavier-wall portions 2 and 3 of the differential-thickness pipe 1 are attained. The width of the thickness changing portion 12 is determined in the same manner as in Method I in which width adjustment is done while the plate still remains flat.

The unnecessary portion is cut off not only for the adjustment of plate width but also for minimizing the out-of-roundness of the formed pipe as the edge portions, if left unremoved, are usually difficult to bend smoothly.

Figure 10:
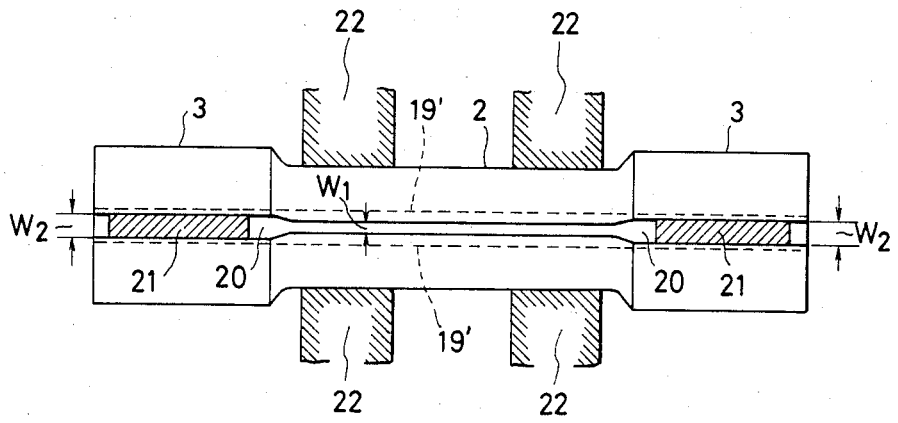
FIG. 10 is a top view of a tubular product with a liner inserted in the opening therein.

The cut-off line 19 on the tubular piece curves throughout the length thereof as shown in FIG. 9 and cutting therealong is not an easy job. But the cutting operation can be made easier by making the curved cut-off line 19 close to a straight line. This correction can be achieved by adjusting the widths $W_1$ and $W_2$ of openings in the lighter- and heavier-wall portions 2 and 3 using a press 22 or other appropriate tool, with a liner 21 inserted in an opening 20 in the heavier-wall portion 3 as shown in FIG. 10.

Figure 6:
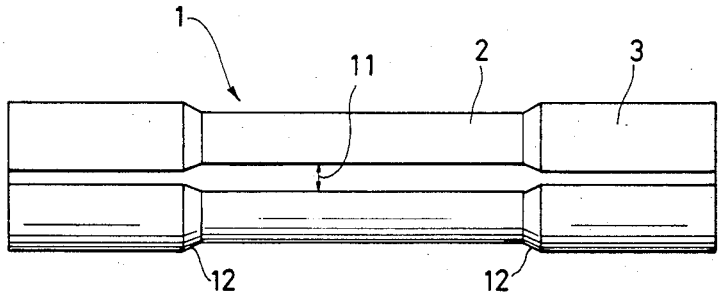
FIG. 6 is a top view of a tubular product immediately after the bending operation.

With the forming effected by using a longitudinally uniformly contoured punch 13 as shown in FIG. 7, the insides of the heavier- and lighter-wall portions are both bent to a substantially uniform radius of curvature. Generally, however, the tubularly formed piece springs back less in the heavier-wall portion than in the lighter-wall portion. with the result that the ultimate radius of curvature of the heavier-wall portion becomes smaller than that in the lighter-wall portion and, therefore, the opening between the butted edges varies greatly between the two portions as shown in FIG. 6.

Figure 11A:
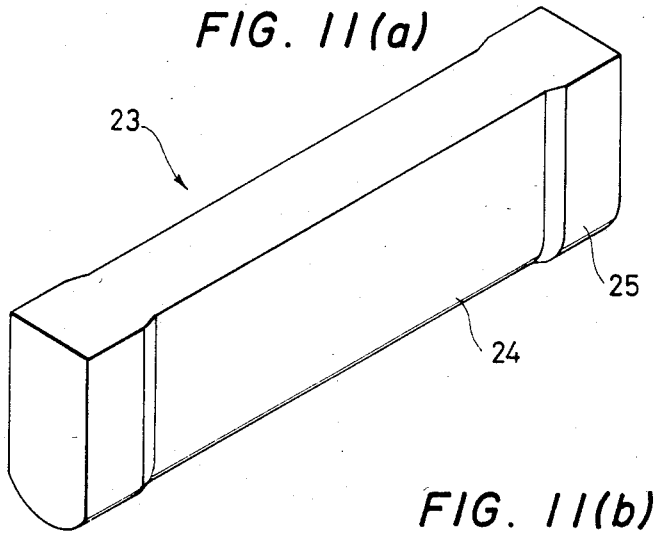
FIGS. 11(*a*) and 11(*b*) are a perspective view and a front view of a bending punch having different curvatures for the heavier and lighter portions.
Figure 11B:
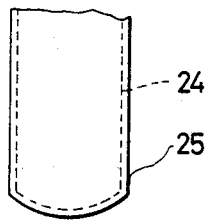

As shown in FIGS. 11(*a*) and 11(*b*), this problem can be solved by using a punch 23 whose radius of curvature in a portion 24 corresponding to the lighter-wall portion of the pipe is made smaller than that in a portion 25 corresponding to the heavier-wall portion in accordance with the differences in the plate thickness, desired curvature and amount of springback between the two portions. Using the punch 23 of this type of design facilitates the forming for final butting and enhances the accuracy of tack welding. The curvature in said two portions may be varied either by machining the individual portions differently or by finishing the punch to the curvature of the lighter-wall portion throughout the entire length thereof and then attaching a liner only to the heavier-wall portion.

Figure 12A:
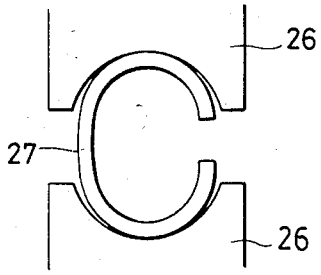
FIGS. 12(*a*) and 12(*b*) are front views showing cramp-type bending tools.
Figure 12B:
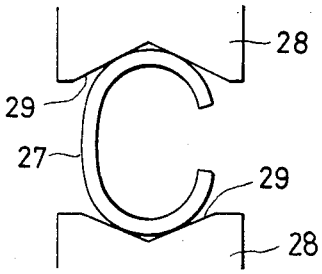

For the achievement of butt welding, both edges of the plate must be brought into uniform contact with each other over the entire length thereof. In some instances, however, such a uniform contact can not be attained. With ordinary tools, it is sometimes difficult to form the material plate into a tubular shape which can accurately meet exacting diametrical specifications. These difficulties, however, can be overcome by use of cramp-type dies as shown in FIGS. 12(*a*) and 12(*b*). The cramp-type die 26 with a smoothly curved working surface, shown in FIG. 12(*a*), covers the periphery of a tubular piece 27, thereby butting together both edges thereof without causing deformation. A simpler tool 28 having a gently tapered V groove 29, as shown in FIG. 12(*b*), or a liner may also prove useful.

Figure 13:
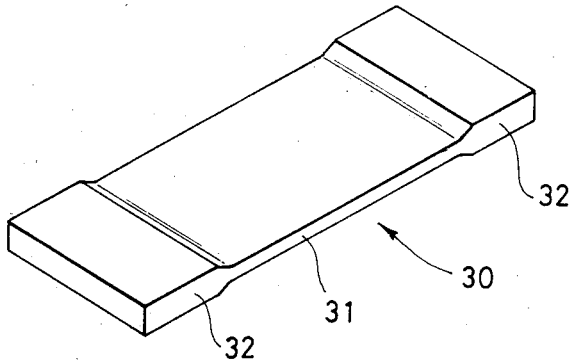
FIG. 13 is a perspective view of a material plate, still unbent, with longitudinally differentiated thickness.

FIG. 13 shows a double-side differential-thickness plate 30 whose thicker portion corresponding to the heavier-wall portion of a pipe protrudes not only externally but also internally. While being bent by the pushing end 14 of the punch 13 shown in FIG. 7, the thicker portion 32 of the plate 30 is pushed radially outward. This method permits using double-side differential-thickness plates as rolled, thereby saving the trouble of preparing one-side differential-thickness plates by machining off the projection on one side thereof.

Figure 14:
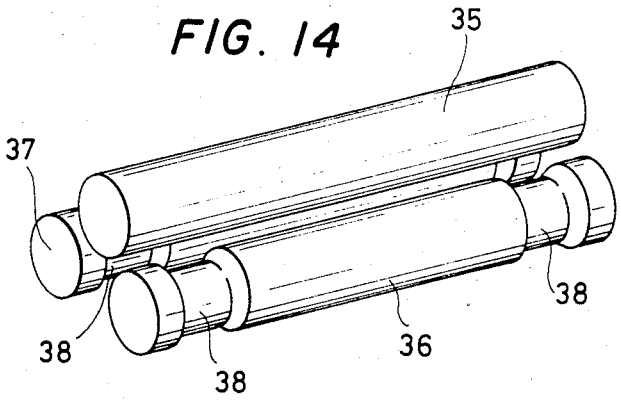
FIG. 14 is a perspective view of an example of a roll cluster of a roll bender used for the bending operation.

Tubular forming can be accomplished not only by press bending as in the cases described in the foregoing but also by roll bending. FIG. 14 shows an example of a roll arrangement and roll profiles on a three-piece roll bender. A reduction work roll 35 and two fixed rolls 36 and 37 are arranged in a pyramidal or triangular cluster. The material plate is bent when passing through the clearance between the reduction roll 35 and the fixed rolls 36 and 37. The fixed rolls 36 and 37 each have grooves 38 in the positions corresponding to the heavier-wall portion of the pipe.

EXAMPLE

Differential-thickness pipes each having an overall length of 6000 mm were made using two different methods. The pipes were desired to have an inside diameter of 450 mm, a lighter-wall portion having an outside diameter of 500 mm and a wall thickness of 25 mm, a 50 mm long transition portion on each side of the lighter-wall portion, and a 300 mm long heavier-wall portion with an outside diameter of 520 mm and a wall thickness of 35 mm on the outside of each transition portion.

Figure 15:
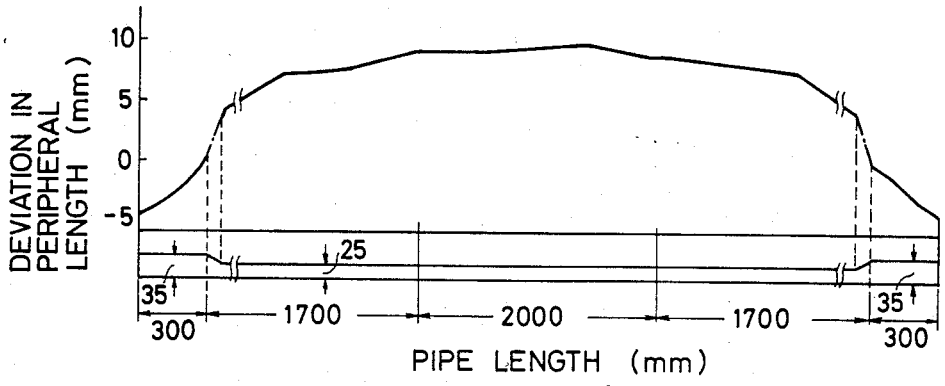
FIG. 15 is a graph of measured deviations in the peripheral length of a differential-thickness pipe made from a material plate with longitudinally differentiated thickness and uniform width.

Using a press bender, a pipe of the above specification was made from a 6000 mm long by 1508 mm wide plate with a 40 kg/mm$^2$ class yield strength that had a thinner portion 25 mm thick, a thicker portion 35 mm thick and 300 mm long, and transition portions 50 mm long each. The obtained differential-thickness pipe did not have good dimensional accuracy, with the peripheral length deviation (measured length minus target length) varying greatly as shown in FIG. 15.

Figure 16:
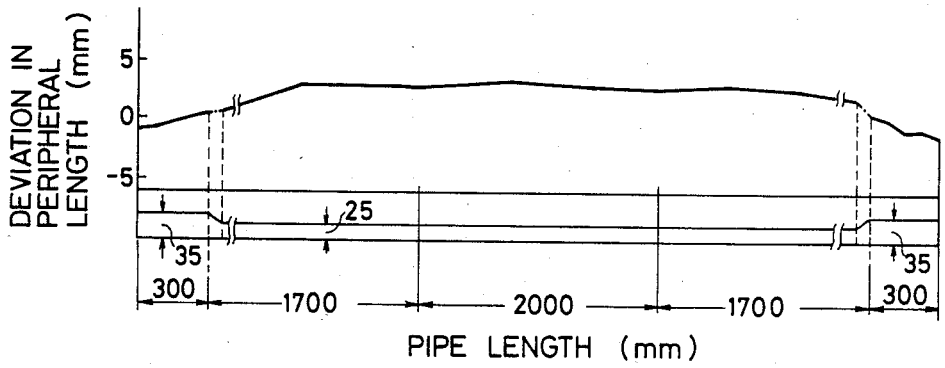
FIG. 16 is a graph of measured deviations in the peripheral length of a differential-thickness pipe more accurately made by the method of this invention.

By contrast, another differential-thickness pipe was made by using a 1580 mm wide plate whose edges were cut away by fusing, in accordance with the method of this invention, so that the desired peripheral length would be obtained after the forming operation has proceeded to some extent. As a result, a differential-thickness pipe of good dimensional accuracy could be obtained. The peripheral length deviation of this pipe is shown in FIG. 16.

By the manufacturing method of this invention, metal pipes with longitudinally differentiated wall thickness with little diametrical variation throughout the length thereof are obtained.

What is claimed is:

1. A method of manufacturing a metal pipe with longitudinally differentiated wall thickness comprising:

preparing a rectangular metal plate having opposite longitudinal edges which abut a thicker portion of said plate, a thinner portion of said plate and a transition portion of said plate between said thicker and thinner portions, said transition portion having a thickness intermediate the thickness of said thicker portion and the thickness of said thinner portion, the thickness of said plate in said thicker portion being greater than the thickness of said plate in said thinner portion;

reducing the width of said plate along each edge of said thinner portion of said plate with respect to the width of said thicker portion of said plate prior to bending said plate into a tubular shape with said edges abutting each other;

removing a portion of said plate along each edge of said plate on either side of said transition portion such that the width of said plate beyond said transition portion towards said thinner portion of said plate is greater than the width of said thinner portion of said plate and the width of said plate beyond said transition portion towards said thicker portion of said plate is less than the width of said thicker portion of said plate, the width of said plate in said transition portion being intermediate the width of said plate on either side of said transition portion;

forming said metal plate which has a reduced width along each edge of said thinner portion into a tubular shape with said edges abutting each other; and welding together the abutted edges of said plate to form a metal pipe.

2. The method of claim 1, wherein the width of the portion of said plate corresponding to the thinner portion of said plate is reduced prior to any bending of said plate into a tubular shape.

3. The method of claim 1, wherein the width of the portion of said plate corresponding to the thinner portion of said plate is reduced after both edges of said plate have been preliminarily bent to a curvature corresponding to the final curvature of the pipe.

4. The method of claim 1, wherein the width of the portion of said plate corresponding to said thinner portion of said plate is reduced after said plate is bent into substantially tubular form.

5. The method of claim 1, wherein said plate is formed into a pipe by means of a punch or die having a curved portion which contacts said thinner portion of said plate, said curved portion having a radius of curvature which is less than the radius of curvature of another curved portion of said die or punch which contacts said thicker portion of said plate.

6. The method of claim 1, wherein said plate is formed into a pipe by means of a punch or die having a liner, said liner having a smaller radius of curvature at a portion of the punch or die which contacts said thinner portion of said plate than the radius of curvature of another portion of the punch or die which contacts said thicker portion of said plate.

7. The method of claim 1, wherein said plate is formed into a pipe by means of a cramp-type die.

8. The method of claim 1, comprising, making said plate thicker on both sides of said plate such that the thicker portion protrudes beyond both surfaces of said thinner portion of said plate; and forming said plate into a pipe by means of a punch and die whereby the thicker portion of the plate is caused to be pushed radially outward as said plate is bent into the shape of a pipe by said punch.

* * * * *